United States Patent [19]

Ritter et al.

[11] 3,991,545

[45] Nov. 16, 1976

[54] PNEUMATIC AUXILIARY DEVICE

[75] Inventors: Helmut Ritter; Max Schnetzer, both of Wattwil, Switzerland

[73] Assignee: Heberlein Maschinenfabrik, Wattwil, Switzerland

[22] Filed: Dec. 22, 1975

[21] Appl. No.: 643,037

[30] Foreign Application Priority Data

Jan. 17, 1975 Switzerland ..... 571/75

[52] U.S. Cl. ..... 57/34 HS; 57/106

[51] Int. Cl.[2] ..... D01H 13/04; D01H 13/28

[58] Field of Search ..... 57/34 R, 34 HS, 34.5, 57/56, 106, 157 R, 157 MS, 157 TS

[56] References Cited

UNITED STATES PATENTS

| | | | |
|---|---|---|---|
| 3,333,407 | 8/1967 | Bruin et al. | 57/106 X |
| 3,605,396 | 9/1971 | Guignard et al. | 57/106 |
| 3,742,695 | 7/1973 | Conrad | 57/34 HS X |
| 3,793,817 | 2/1974 | Beringer et al. | 57/34 HS |
| 3,813,863 | 6/1974 | Ritter | 57/34 HS |
| 3,942,312 | 3/1976 | Venot | 57/106 X |
| 3,946,546 | 3/1976 | Venot | 57/34 HS |

*Primary Examiner*—Donald E. Watkins
*Attorney, Agent, or Firm*—Larson, Taylor and Hinds

[57] ABSTRACT

A pneumatic auxiliary apparatus for introducing a running yarn into a false-twist texturing machine is described wherein two suction devices are arranged for attachment to perforated suction tubes extending along the machine and connected to a suction source. One such device has a suction nozzle connected by a pliable tube to a slide valve. This nozzle can be used to draw yarn through a tube leading from a false-twist imparter (associated with a heating plate) to a point where the yarn can be inserted into a delivery device that leads the yarn to the entry of a yarn guiding tube extending through a second heating device. The nozzle can then be mounted in a support at the said entry to enable the suction draw the yarn through the pliable tube to the slide valve. The valve is then closed and the valve is arranged so that, when being closed, it co-operates with a knife to sever the yarn. The second suction device is then applied to draw the yarn through the second heating device to a point where, on removal of the second heating device, it may be fed to a wind-up device.

5 Claims, 3 Drawing Figures

PNEUMATIC AUXILIARY DEVICE

FIELD OF THE INVENTION

The present invention relates to pneumatic auxiliary apparatus for introducing a running yarn into a false-twist texturing machine having a second heating device provided beyond the false-twist imparter.

DESCRIPTION OF THE PRIOR ART

It is known that, in a false-twist texturing machine, a temporary high twist is imparted to a yarn of synthetic material, which is heat-set before the twist is reversed. In order to reduce its elasticity to a desired extent, the crimped yarn may be subjected to a second heat-setting operation. Apparatus for continuous false-twist texturing and post-setting are known in which, for heating the yarn in the high-twisted condition, a heated contact plate is used and in which, for post-setting, a closed heating device containing a hot gaseous medium is placed beyond the false-twist imparter. In this heating device, tubes of a small diameter distributed along the whole length of the machine may be provided for the passage respectively of the individual yarns at the various treatment posts along the machine.

In order to introduce the yarns into machines of this type, pneumatic auxiliary means, for example suction pistols are used. The use of such auxiliary means however calls for great skill on the part of the staff of operators in view of the high yarn running speeds of up-to-date false-twist texturing machines, particularly when introducing the yarns into the tubes of a closed heating device.

SUMMARY OF THE INVENTION

It is the purpose of the present invention to provide a pneumatic auxiliary apparatus by means of which the yarn can be introduced into the texturing machine safely and without difficulty and therefore without making to high requirements as to the skill of the staff of operators. This problem is resolved according to the present invention by means of a pneumatic auxiliary apparatus which includes a first suction device disposed in the zone between the false-twist imparter and the second heating device, said suction device being usable for locally fixing the yarn in this zone, and comprising a suction nozzle which can be fixed temporarily in the path of the yarn, means for simultaneously interrupting the suction effect and for cutting the yarn, as well as a second suction device disposed in the zone between the second heating device and the wind-up device for introducing the yarn into the second heating device after the yarn has been cut in the first suction device. In the first suction device, the means for simultaneously interrupting the suction effect and for cutting the yarn may advantageously consist of a body with a lengthwise through-bore and a slide valve which can be shifted perpendicularly with respect to the axis of the bore for closing the bore, and which co-operates with a knife in severing the yarn.

DESCRIPTION OF THE DRAWINGS

In order that the invention may be clearly understood and readily carried into effect an example thereof will now be described with reference to the accompanying drawings wherein:

Referring to FIG. 1, yarn 1 coming from a delivery bobbin (not shown) passes in sequence through a first delivery device 2, a thread-guide 3, over a convex surface of a heating plate 4, through thread-guides 5, 6, a false-twist imparter 7, a thread-guide 27, a second delivery device 9, a second heating device 19, a third delivery device 24 and from there the yarn reaches a wind-up device 25. Between the delivery device 9 and the second heating device 19, a fork-like support 10 is positioned to enable a suction nozzle 11 to be temporarily fixed in the yarn path. The support 10 is fixed on a tubular member 18 which is disposed on the upper part of the heating device 19. One end of a pliable tube 12 is connected to the nozzle 11, the other end thereof being connected to a member 13 which is provided with a fixing clamp 14. The clamp 14 can be secured to a tube 15 extending over the whole length of the machine and connected so as to conduct air to a suction fan (not shown), the tube having suction openings distributed at regular distances along its length. The member 13 has a bore 26 (FIG. 2) extending through it and a slide valve 16 which can be moved perpendicularly to the axis of the member 13 and is provided with a handle. The member 13 is also provided with a knife 17. The heating device 19 is closed on all sides and comprises, for each treatment post, a tube 19′ of small diameter, through which the yarn can pass, extending completely through the device.

Figure 1:
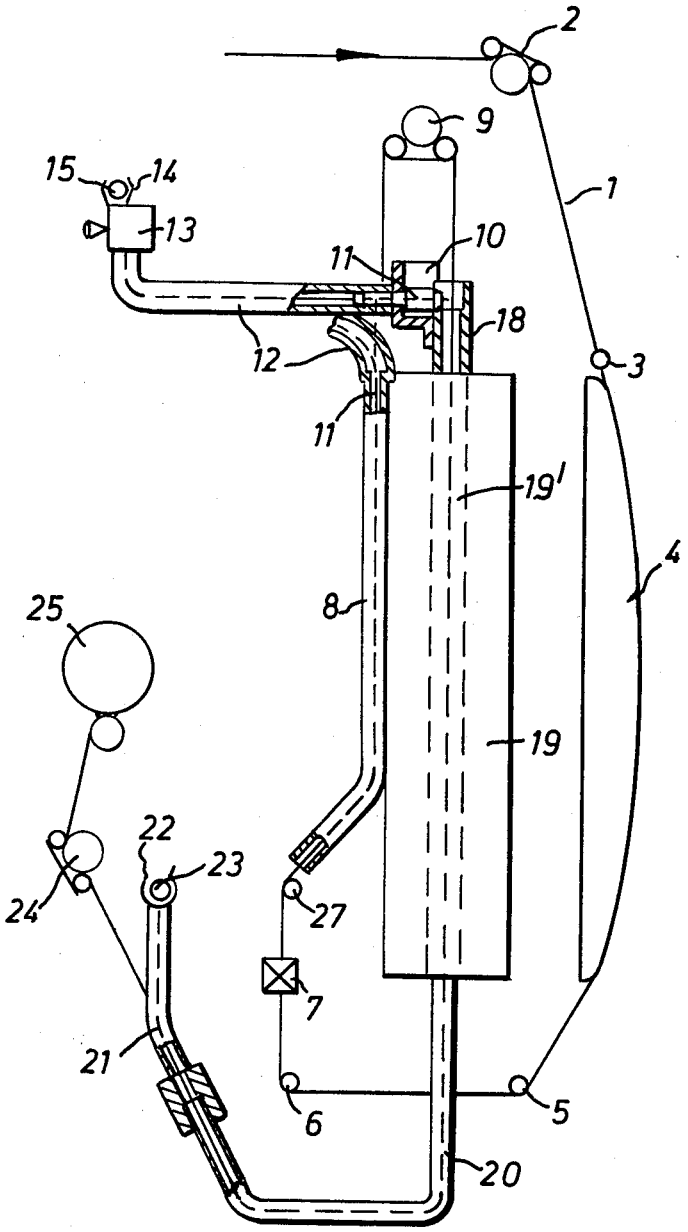
FIG. 1 shows schematically a pneumatic auxiliary apparatus mounted on a false-twist machine.
Figure 2:
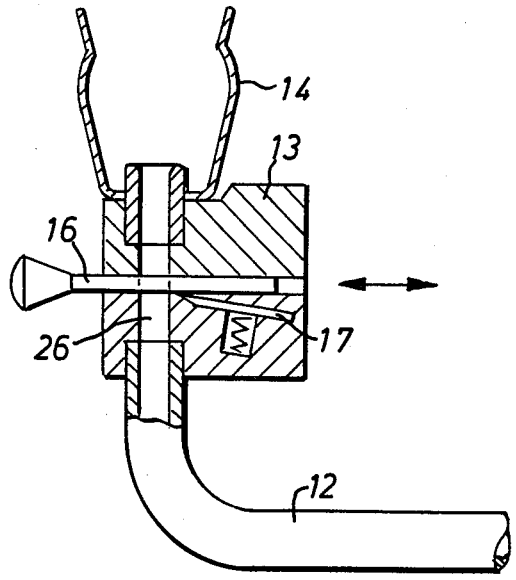
FIGS. 2 and 3 respectively show on an enlarged scale sectional elevations of two details of the apparatus of FIG. 1.
Figure 3:
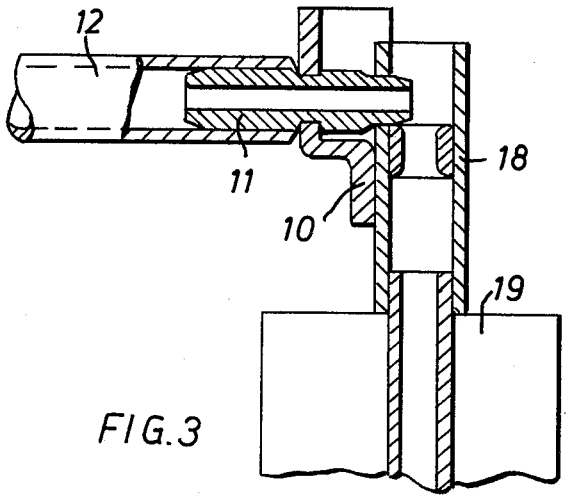

On the lower part of the heating device 19 is disposed an angular tube 20 on the free end of which a pliable tube 21 can be mounted. The remote end of the pliable tube 21 can be attached by means of a clamp 22 to a further tube 23 having suction openings and extending over the whole length of the machine. The tubes 18, 19′ as well as a vertical portion of tube 20 are co-axial. On each treatment post, a yarn guiding tube 8 is disposed in parallel relationship with a lateral wall of the heating device 19.

The above described apparatus operates as follows:

Initially, the yarn 1 is introduced into the texturing machine until it reaches the false-twist imparter 7 whereupon the clamp 14 of the tube 12 is attached to the suction tube 15 and the nozzle 11 is initially mounted on the upper end of the yarn guiding tube 8. The yarn coming from the false-twist imparter 7 is now sucked through the tube 8. The yarn still being sucked by the nozzle 11 is inserted into the second delivery device 9. Thereupon, the nozzle 11 is transferred to the support 10 and the slide valve 16 in member 13 is again opened. Thereby, the yarn 1, after having passed through the delivery device 9, is still sucked into the tube 12 by the nozzle 11. Thereafter, the pliable tube 21 is mounted on the angular tube 20 and the other end of the pliable tube 21 connected to tube 23 by means of the clamp 22. The resulting suction effect through the tube 19′ and through the angular tube 20 is somewhat lower because of the longer path through tubes 19′, 20, 21 than the suction effect of nozzle 11. Now, the slide valve 16 is closed, so as to interrupt the suction effect of nozzle 11, and at the same time the yarn 1 is cut off between the slide 16 and knife 17. The yarn 1 is now sucked through the tube 19′ in the heating device 19 and through the angular tube 20 under the suction effect of suction tube 23. The suction tube 23 can now be removed and the yarn passed through the delivery device 24 to the wind-up device 25.

We claim:

1. A pneumatic auxiliary apparatus for introducing a running yarn into a false-twist texturing machine having a false-twist device in association with a first heating device, the machine also having a second heating device formed for the passage of yarn therethrough from an entry end thereof, a wind-up device for yarn after its passage through said second heating device, and suction means; said apparatus comprising means defining a yarn path for yarn passing from said false-twist imparter towards said entry end of said second heating device, a first suction device including a suction nozzle for temporarily mounting in said yarn path in communication with said suction means to draw said yarn through said false-twist device and locate said yarn for delivery into said entry end of said second heating device, means for receiving said yarn when so located and co-operating with said suction nozzle for introducing said yarn to said entry end, means for interrupting communication between said suction means and said nozzle, a knife operative to cut the yarn when said communication is interrupted to provide a free length of yarn extending through said nozzle into said entry end, and a second suction device adapted to communicate with said suction means and for temporary mounting in a location to draw said yarn through said second heating means and towards said wind-up device.

2. Apparatus according to claim 1, in which said interrupting means comprises a member formed with a longitudinal bore therethrough, a slide valve mounted for reciprocation in said member transversely to said bore in opening and closing the passage constituted by said bore, means at one end of said bore for connecting said bore to said suction means, and means at the other end of said bore for connecting said bore to said nozzle, said knife being mounted in said member to cooperate with said slide valve to sever the yarn while said slide valve is moving to close said passage.

3. Apparatus according to claim 1, for introducing the running yarn into a machine wherein said second heating device comprises a closed elongated container for heating medium and a tube for the passage of yarn therethrough extending through said container from an inlet end to an outlet end thereof, said means defining said yarn path including a second tube through which the yarn passes to an outlet end thereof adjacent said inlet end of said first-mentioned tube, said nozzle being mounted for movement between said outlet end of said second tube and said inlet end of said first-mentioned tube to aid the introduction of the yarn into said second heating device.

4. Apparatus according to claim 3, in which said first suction device includes a pliable tube through which suction is applied to said nozzle and which provides for said movement of said nozzle, said apparatus further comprising a fork-like support for said nozzle, said support being fixed at said inlet end of said first-mentioned tube.

5. Apparatus according to claim 1, in which said second suction device comprises an angularly bent, tubular yarn guide for conveying yarn from said second heating device to an outlet end of said guide, and a suction tube detachably mounted on said outlet end of said guide and adapted for connection to said suction means.

* * * * *

UNITED STATES PATENT OFFICE

CERTIFICATE OF CORRECTION

PATENT NO. : 3,991,545

DATED : November 16, 1976

INVENTOR(S) : Ritter et al

It is certified that error appears in the above-identified patent and that said Letters Patent are hereby corrected as shown below:

Please change the name of the Assignee to read

-- Heberlein Maschinenfabrik, AG--

Signed and Sealed this

Seventeenth Day of May 1977

[SEAL]

*Attest:*

RUTH C. MASON
*Attesting Officer*

C. MARSHALL DANN
*Commissioner of Patents and Trademarks*